US005235254A

United States Patent [19]

Ho

[11] Patent Number: 5,235,254

[45] Date of Patent: Aug. 10, 1993

[54] FLUORESCENT LAMP SUPPLY CIRCUIT

[75] Inventor: Joseph K. P. Ho, Kowloon, Hong Kong

[73] Assignee: PI Electronics Pte. Ltd., Singapore

[21] Appl. No.: 675,239

[22] Filed: Mar. 26, 1991

[30] Foreign Application Priority Data

Apr. 23, 1990 [GB] United Kingdom ..... 9009027
Jul. 30, 1990 [GB] United Kingdom ..... 9016691

[51] Int. Cl.[5] ..... G05F 1/00; H05B 37/02

[52] U.S. Cl. ..... 315/219; 315/307; 315/224; 315/DIG. 2; 315/DIG. 4; 315/DIG. 5; 315/DIG. 7

[58] Field of Search ..... 315/219, 307, DIG. 2, 315/DIG. 4, DIG. 5, DIG. 7, DIG. 2, 208, 224, 7, 307, 308, 291, 209 R, 246, 276, 283

[56] References Cited

U.S. PATENT DOCUMENTS 3,611,021 10/1971 Wallace ..... 315/239
3,710,177 1/1973 Ward ..... 315/DIG. 2
4,415,839 11/1983 Lesea ..... 315/308
4,700,113 10/1987 Stupp et al. ..... 315/DIG. 2
4,723,098 2/1988 Grubbs ..... 315/306
4,791,338 12/1988 Dean et al. ..... 315/174
4,904,905 2/1990 Olon ..... 315/307
4,949,016 8/1990 De Bijl et al. ..... 315/DIG. 5
4,954,754 9/1990 Nilssen ..... 315/219
5,055,993 10/1991 Miyata et al. ..... 315/219

FOREIGN PATENT DOCUMENTS 0178852 4/1986 European Pat. Off. .

*Primary Examiner*—Robert J. Pascal
*Assistant Examiner*—Michael B. Shingleton
*Attorney, Agent, or Firm*—Townsend and Townsend Khourie and Crew

[57] ABSTRACT

A power circuit for a fluorescent discharge lamp comprising a converter for producing a DC output. A voltage controlled oscillator is driven by the output from the converter, the oscillator providing a high voltage output for driving the lamp. The frequency of the output increases and decreases with increases and decreases in the powering voltage from the converter. A current detector detects the current passing through the lamp and controls the output voltage of the converter according to that current to increase the the voltage to strike the lamp and then control the voltage to give the required running current.

13 Claims, 5 Drawing Sheets

UPPER TRACE : DRAIN OF Q5 UNDER NORMAL OPERATING CONDITIONS

LOWER TRACE : OUTPUT PIN 3 OF TIMER IC U2

UPPER TRACE : DRAIN OF Q5 WHEN STRIKING A FLUORESCENT LAMP AT 0°C

LOWER TRACE: OUTPUT PIN 3 OF TIMER IC U2

FLUORESCENT LAMP SUPPLY CIRCUIT

This invention relates to a fluorescent lamp supply circuit and in particular an invertor used to start and power any form of fluorescent lamp.

The invention has a special application in the powering of cold cathode fluorescent lamps which are used as the backlights of a liquid crystal display panel used in such applications as portable TV sets, portable computers, (laptops and palm tops) and portable word processors. The invention however is not limited to the powering of such cold cathode fluorescent lamps but can be used to power any fluorescent lamp including those with heated electrodes and provides a very efficient supply circuit which has application in connection with energy saving, particularly in illuminating public areas where such lamps are usually left on twenty four hours a day.

BACKGROUND TO THE INVENTION

Generally the display panels of equipment like a laptop computer comprises some form of back light and in front of this is a liquid crystal display. The backlight may be an electroluminescent panel or a number of cold cathode fluorescent tubes with a suitable diffuser to ensure even lighting. Generally speaking there are problems with electroluminescent panels in that their long term reliability is not good and so the use of cold cathode fluorescent lamps is preferred.

A problem however with such lamps and their supply circuits is that they are relatively inefficient. For example, in a notebook computer with a black and white display the total energy required to drive the backlight amounts to something of the order of one third to one half of the total energy consumption. In a notebook computer with a colour display this proportion can be one half to two thirds of the total energy consumption. It is therefore highly desirable provide an invertor circuit for such cold cathode fluorescent lamps which is very efficient in terms of its energy consumption whilst still remaining small and compact in size. In that connection efficiency is also of considerable importance since portable equipment of this type usually has the option of drawing its power either from a mains supply or from battery power. If the efficiency of illumination is not high when the device is operating on battery power, then any wastage of power reduces the overall operating time on the battery power before re-charging is necessary.

Generally the invertor circuit used to supply a backlight needs to be positioned close to the display to minimise the length of high frequency leads which need mechanical protection and safety insulation to reduce high frequency radiation and to reduce risks of electric shock. In portable laptop computers therefore the invertor circuit must usually be positioned in the hinged display.

Cold cathode fluorescent lamps as used in this context generally require a high striking voltage, e.g. 1400 V peak, to ionize the gases in the lamp and so turn it on. Before the lamp is struck it has a high impedance because it is essentially an open circuit but, once it strikes, its resistance reduces to a low figure and it needs a lower voltage to run it. To ensure that the supply circuit is not short circuited it is generally necessary to include some form of ballasting reactance such as capacitor or inductor to limit the operating current and the resulting voltage drop across the reactance reduces the voltage actually applied across the lamp to its normal running voltage which tends to be of the order of 300 to 400 V rms.

To ensure a reasonably high overall efficiency it is desirable to operate such supply circuits at high frequency, e.g. 20 to 60 KHz. That usually represents the best overall compromise since the efficacy of fluorescent lamps increases asymptotically to approach a maximum at higher frequencies whilst efficiency of the driving circuit decreases with increase in frequency. However, conventional electronic ballast circuits for this sort of frequency supply generally need a relatively large sized transformer with a large core and/or a large number of turns. It is usually the size of this transformer which limits the overall thickness of the invertor circuit when fitted into the hinged display of a portable laptop computer.

The invention therefore aims to address these problems and to provide a supply circuit for any form of fluorescent lamp which is of improved efficiency and of compact size.

BRIEF SUMMARY OF THE INVENTION

According to the invention there is provided a power circuit for a fluorescent discharge lamp comprising converter means for producing a DC output, voltage controlled oscillator means driven by the output from the converter means, the oscillator means providing an output for driving the lamp, the frequency of the output increasing and decreasing with increases and decreases in the powering voltage from the converter means, and current detection means for detecting the current passing through the lamp and controlling the output voltage of the converter means according to that current to increase the voltage to strike the lamp and then control the voltage to give the required running current, i.e. the current required to keep the lamp operating in a steady manner once it has been struck.

By operating in this manner one can provide a very high frequency supply to strike the discharge tube when the current through it is zero or at a low level. The efficiency of supply at such a time may be low but very rapidly the tube will strike and discharge and thereafter a normal current will flow. Then the frequency of the voltage controlled oscillator means can reduce to a normal operating frequency where the circuit operates at optimum efficiency. Therefore the period of low efficiency operation is limited to the initial striking of the lamp, yet one can use one and the same transformer for the oscillator output to drive the tube and this can be of a small size which will be efficient under the normal operating conditions of the lamp.

Also the tube can be driven directly without the need for a ballasting reactance. In that connection the feed back and control of the converter means by the current detection means should be fast so as to limit the current flow immediately the lamp strikes and therefore changes from high impedance to low impedance. This will ensure that the lamp is not damaged by high currents.

The converter means are regulated by the feed back from the current detection means with a view to tending to keep the running current at a substantially constant figure and to compensate for any minor changes in this running current required to keep the lamp operating. Thus, the DC output will tend to increase when the current is below the desired figure and vice versa. Also the actual running current flowing through the lamp can be user adjustable to vary the brightness of the lamp.

Also according to the invention there is provided a method of operating a fluorescent discharge lamp in which the lamp is driven by means of a high frequency high voltage power source which drives the primary of a transformer with the secondary directly connected to the lamp, the power source operating within a substantially constant frequency range dependent upon the lamp voltage, e.g. of 30 to 70 and more preferably of 30 to 60 KHz, once the lamp is in operation, and current detection means being provided for monitoring the current through the lamp and for increasing the frequency and voltage of the supply from the oscillator when zero or low current is detected so as to ensure initial striking of the lamp.

Because the lamp is connected directly across the secondary, no ballasting reactance is included in series within the lamp.

Also the transformer could be part of an oscillator constituting the power source or the power transformer of a power amplifier driven by a variable voltage, variable frequency signal.

In any form of transformer driven by a sine wave it size is controlled by the total flux linkage which is given by the following equation:

$$\text{Integral} \int_0^{T/2} V_{peak} \sin[2 \cdot \pi \cdot f \cdot t]dt = N.A.B_{max}$$

where

T is the period of the high frequency driving voltage, $V_{peak}$ is the peak voltage, f is the frequency, which is equal to 1/T, N is the total number of turns of the transformer, A is the effective cross sectional area of the transformer core, and $B_{max}$ is the maximum allowable flux excursion.

To generate a high voltage at a particular frequency using a particular type of core material, the values T, f, V and $B_{max}$ are fixed and determine the value of the product N.A. The number of turns N required determines the area of the winding window and the area A determines the area of cross section of the core. Both of these together determine the size of the transformer.

As can be appreciated from this equation the product N.A. $B_{max}$ is a constant determined by a core size and the number of turns on the core. Therefore if one wishes to make such a transformer small enough to fit into the profile of the display of a laptop computer, N and A must be small. Equally to obtain sufficient output from such a transformer to drive a fluorescent tube it is necessary to increase frequency if one wishes to increase the voltage so as to provide a high enough voltage to strike the lamp initially. However above about 60 KHz the efficiency of operation of the invertor circuit reduces and it is obviously undesirable to run the invertor continuously under these conditions. The invention avoids this problem however by increasing the frequency of operation of the oscillator circuit dramatically during the initial striking of the discharge and, since this will only be a very short period in the overall operating time for the lamp, this will not seriously affect overall efficiency. As soon as the lamp is struck and starts to run normally then the frequency can be reduced to a normal frequency and normal voltage. Thus under normal circumstances the discharge tube will operate readily at a frequency of 20 to 150 KHz and more desirably 30 to 60 KHz with an output voltage of around 300 to 400 VAC. For striking the tube, however, the frequency will need to be about 2 to 2½ times the normal running frequency, e.g. 40 to 150 or even 400 KHz, the actual frequency depending, inter alia, upon the temperature of the tube and whether the tube is in the dark or exposed to light. The circuit of the invention will automatically raise its output frequency until the tube strikes.

The converter means can be any high efficiency DC-DC converter which can deliver a very wide output voltage. Examples of suitable converters are boost, buck an flyback converters and their topological equivalents which can generate a relatively wide output voltage range. Thus the converter means can comprise an electronic switch controlling the switching of current through an inductor, the output from the inductor being rectified and stored in a capacitor, the potential across the capacitor providing the DC output to supply the voltage controlled oscillator. Various means can be used to vary the potential of the DC output; for example, the duty cycle of the switching of the electronic switch can be varied, i.e. increased duty cycle to give increased DC output voltage and vice versa. Therefore the pulse width modulation means controlling the operation of the switch should be controlled by the value of the current through the lamp as detected by the current detection means.

Also the brightness of the lamp can be controlled in a similar manner by controlling the converter to vary the steady DC output to the voltage controlled oscillator. Thus, the pulse width modulation means can be supplied with a signal from a comparator which has one variable input voltage dependent upon a brightness control, e.g. the output potential across a variable resistor, and another variable input potential is dependent upon the current through the lamp and obtained, for example, by rectifying the output current driving the lamp and passing the rectified output through a fixed resistor. In this way, the output current signal can be continuously compared with the set but adjustable brightness signal so that during the initial striking of the lamp, the converter will boost its output to provide the high striking voltage required, but as soon as the lamp starts to run, the converter output will be reduced to a level to balance the set and desired brightness.

In order to ensure a long life for the fluorescent discharge tube powered by the circuit according to the invention the output wave from the oscillator should provide the minimum peak voltage and peak currents for a fixed power or a fixed root means square value. It is desirable therefore that the output from the oscillator be of a square shape or a nearly square trapezoidal shape instead of a sine wave shape. Sine waves produce peaks that are 40% higher than corresponding square or trapezoidal waves with the same root mean square value. Moreover, a trapezoidal wave is more desirable than a square wave because its gentler slopes produce less high frequency harmonics and hence less radio frequency interference. This can be achieved according to a preferred embodiment of the invention by ensuring that the magnetic energy in the transformer charges the parasitic capacitances in the electronic switches controlling the oscillator and ensuring that the switching of the electronic switches only occurs when there is zero voltage drop across them. In this way one can avoid current spikes in the output transistors and avoid sharp voltage transitions, so reducing radio frequency interference.

The invention is not solely limited to the energizing of fluorescent discharge tubes used in the backlight of say a laptop computer but has general application to all forms of conventional fluorescent lighting systems. Thus, when using the circuit of the invention one can obtain a significant improvement in efficacy, e.g. as much as 20% over conventional electronic ballasts used to power any form of fluorescent discharge tube lamp, and even that conventional electronic ballast is itself already a substantial improvement in efficacy, e.g. 20% to 30%, over conventional magnetic ballast where a large inductor or the like is positioned in series with the tube in conventional lighting systems to limit the operating current which flows when the tube is operating normally. By using the circuit of the invention therefore in conventional fluorescent lighting systems for offices and the like substantial energy savings are possible and in addition the circuit is of small size, and whilst this is not a critical limiting factor in conventional lighting, it is still desirable that the circuit be reasonably unobtrusive and far more desirable that it be highly efficient since this produces less waste heat output and in circumstances such as air conditioned offices this again can represent a significant saving in the cost of running the air conditioning.

DESCRIPTION OF THE DRAWINGS

The invention will now be described, by way of example, with reference to the accompanying drawings, in which.

DESCRIPTION OF THE PREFERRED EMBODIMENTS

Figure 1:
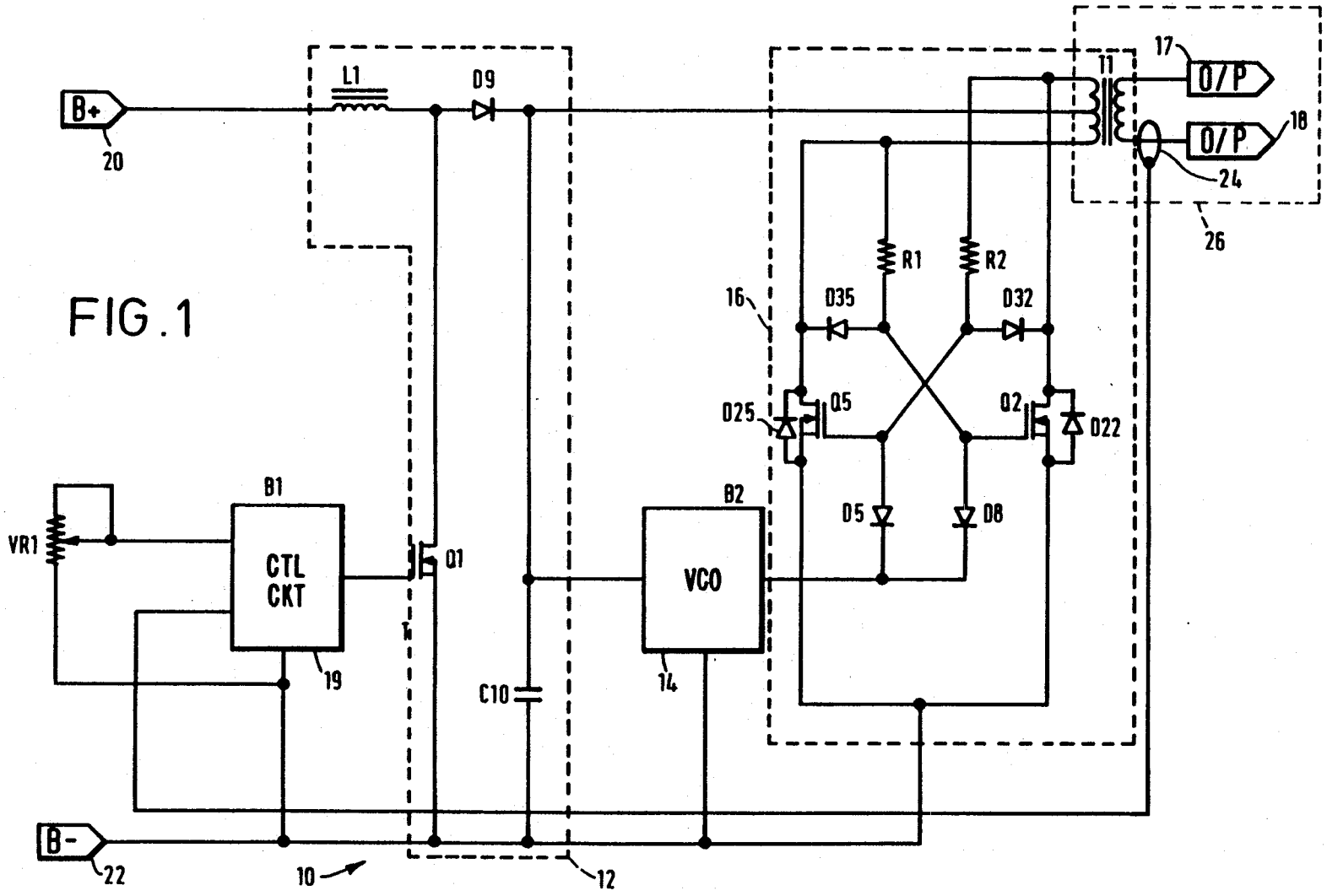
FIG. 1 is a block circuit diagram showing a circuit according to the invention.

The circuit 10 shown in FIG. 1 comprises a boost converter 12 whose output drives a voltage controlled oscillator 14. The output from that oscillator 14 drives a push-pull power invertor 16 which includes an output transformer T1. The secondary of that transformer has output terminals 17 and 18 directly connected to a cold cathode fluorescent discharge lamp, not shown, to power it.

The boost converter 12 includes an inductor L1, diode D9 and output capacitor C10. Also it includes an electronic switch Q1 in the form of a field effect transistor (FET). The gate of the FET is controlled by a control circuit 19 to control the rate and duration of switching of the switch Q1 and accordingly the output voltage developed across the capacitor C10. Thus with an input DC supply across terminals 20 and 22, the output voltage across the capacitor C10 can be varied as required, independent of the actual input DC supply voltage.

The control circuit 19 receives an adjustable input signal across a variable resistor VR1. This provides a reference signal level which can be manually adjusted and set. This adjustment can therefore be used as an overall brightness control for the lamp so setting the steady output voltage across the capacitor C10 in the steady operating condition of the lamp. The circuit 19 also receives a signal from a current sensing loop 24 which monitors the output current passing at that instant through the lamp.

The power invertor 16 includes the output transformer T1, a pair of push pull connected output power switches Q2 and Q5 paralleled by a corresponding pair of free wheeling rectifiers D22 and D25, gate drive steering means consisting of diodes D5, D8, D35 and D32 and pull up resistors R1 and R2.

The voltage controlled oscillator 14 operates at a frequency which increases and decreases with the output voltage of the DC-DC converter, and delivers a narrow negative pulse to switch off the output switches Q2 and Q5 at the end of each half cycle.

Output power switches Q2 and Q5 are turned on alternatively by the gate drive steering circuitry. If power switch Q5 has been conducting in a previous half cycle and switched off through diode D5 by a narrow negative pulse from the voltage controlled oscillator, the magnetizing flux built up in the transformer T1 will be of such a polarity that pulls the drain of power switch Q5 up and the drain of power switch Q2 down. The potential at the drain of power switch Q2 is clamped to ground by diode D22, the body diode of Q2 while the drain of power switch Q5 swings to twice the DC-DC converter output voltage. Upon the positive transition of a narrow negative pulse from the voltage controlled oscillator 14, diode D32 will clamp the gate of switch Q5 to ground while the gate of switch Q2 is pulled up by resistor R1, turning switch Q2 on. This scheme provides zero drain voltage switching as both switches are switched on or off while their drain voltage is at ground potential, reducing most of the switching losses.

In operation the converter 12 provides a regulated DC supply on capacitor C10 for the power invertor 16. The DC output voltage is regulated in such a way to maintain a constant high frequency current through the cold cathode fluorescent lamp as determined by the setting of the brightness control resistor VR1. The DC output voltage will tend to decrease for any tendency of the output current to increase and the DC output voltage will tend to increase for any tendency of the output current to decrease.

Before the fluorescent lamp strikes, the DC output voltage shoots up to a very high level a few times higher than the normal operating DC voltage, as a result of the current regulating loop 24 which senses zero lamp current.

The power invertor 16 takes its power from the output of the DC-DC converter 12, delivering a high frequency output voltage directly proportional to the DC-DC converter output voltage on capacitor C10, running at a frequency that increases with the DC-DC converter output voltage and generating a high frequency high voltage for driving the fluorescent lamp directly without going through a ballasting reactance which is routinely used in conventional supply circuits for fluorescent lamps. The output of the power inversion stage could be a sine wave, a square wave or some other suitable driving waveform.

Before the lamp strikes, the output current feedback circuit senses zero lamp current and pushes the output voltage of the DC-DC converter 12 to a high level, several times higher than the normal operating output. The power inversion stage, delivering an output voltage directly proportional to its own input voltage, produces the high voltage level required to strike the lamp. After the lamp has turned on, the current sensing loop 24 reduces the DC-DC converter output voltage back to normal. This is in contrast with prior circuits where the high voltage required for striking the lamp is maintained all the time and a reactance used to limit the current flowing through the lamp in normal operation.

In a circuit according to the invention, the power transformer driven by a square wave or trapezoidal wave or sine wave power invertor need only handle either:

a. the normal running voltage, e.g. 300 V rms (300 V peak for a square wave) at a normal operating frequency of the lamp, e.g. 46 KHz, or
b. the very high starting voltage, e.g. 1400 V peak at a much high frequency, e.g. 89 KHz.

This transformer need only have a N.A product of 0.0075 square meter, i.e. one third that of a transformer required in the conventional approach.

Figure 4A:
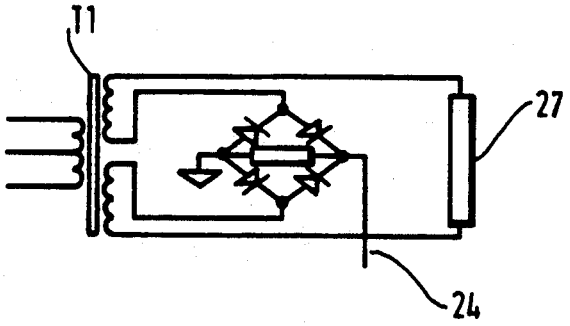
FIGS. 4A, 4B and 4C are detailed circuit diagrams showing respectively variants for powering a single cold cathode fluorescent tube, a hot cathode fluorescent tube, and two cold cathode fluorescent tubes, indicating the possibility of powering single or multiple, cold or hot, cathode fluorescent lamps.
Figure 4B:
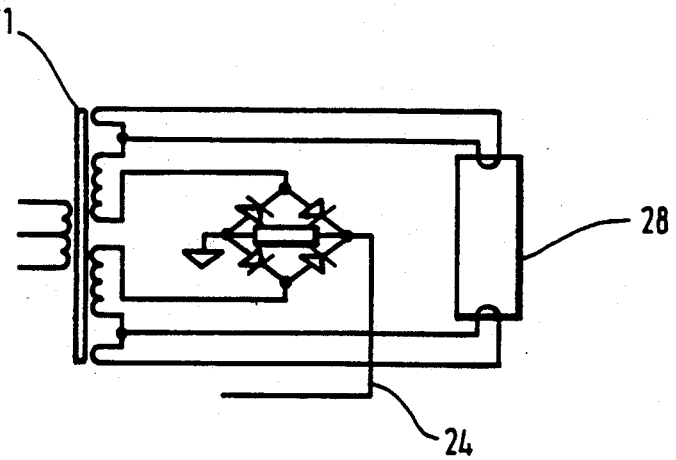
Figure 4C:
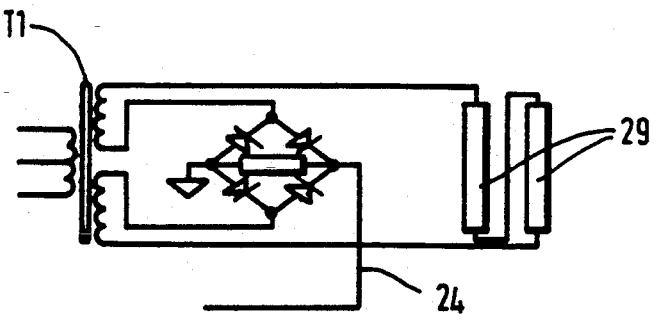

FIGS. 4A to 4C shown in more detail the area 26 shown in FIG. 1 including the transformer T1. In particular these Figures shown possible arrangements used for various fluorescent lamps.

FIG. 4A shows the arrangement for the secondary of the transformer T1 where the lamp 27 is a single cold cathode fluorescent lamp. By contrast FIG. 4B shows the arrangement required when the lamp 28 is a hot cathode lamp with heating electrodes at it's ends. Further FIG. 4C shows the arrangement when there are two cold cathode lamps 29, these lamps being powered in series from the secondary of the transformer T1.

Although the circuit shown in FIG. 1 employs a boost converter 12, this could be replaced by another type of converter such as a buck converter with an appropriate change in the voltage supply across the terminals 20 and 22.

Further, although the circuit shown in FIG. 1 uses a push pull arrangement of the power switches Q2 and Q5 to drive the transformer T1, alternative arrangements using a half bridge or a full bridge to drive the transformer T1 are equally possible.

Figure 2A:
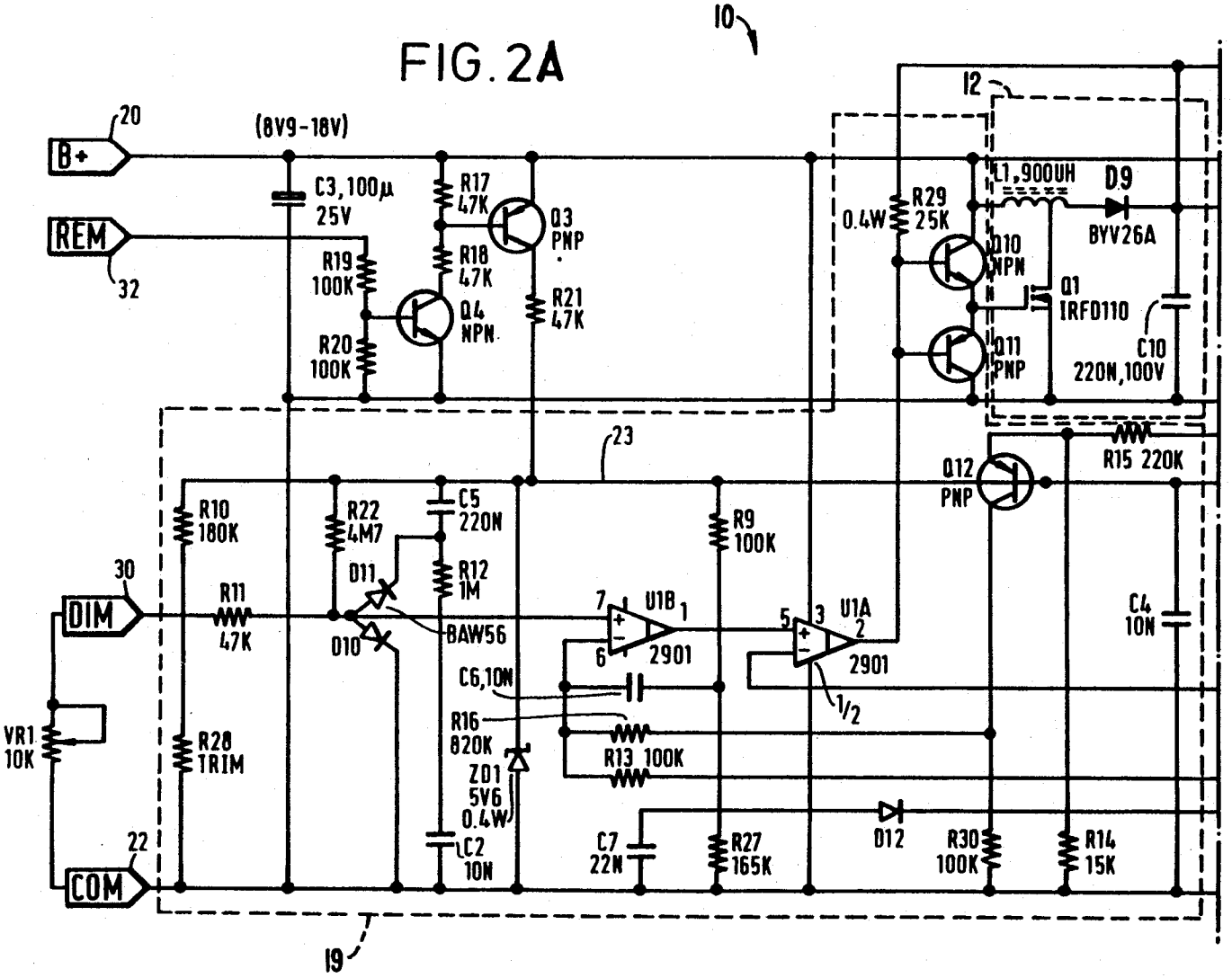
FIGS. 2A and 2B are more detailed diagrams of the circuit shown generally in FIG. 1.
Figure 2B:
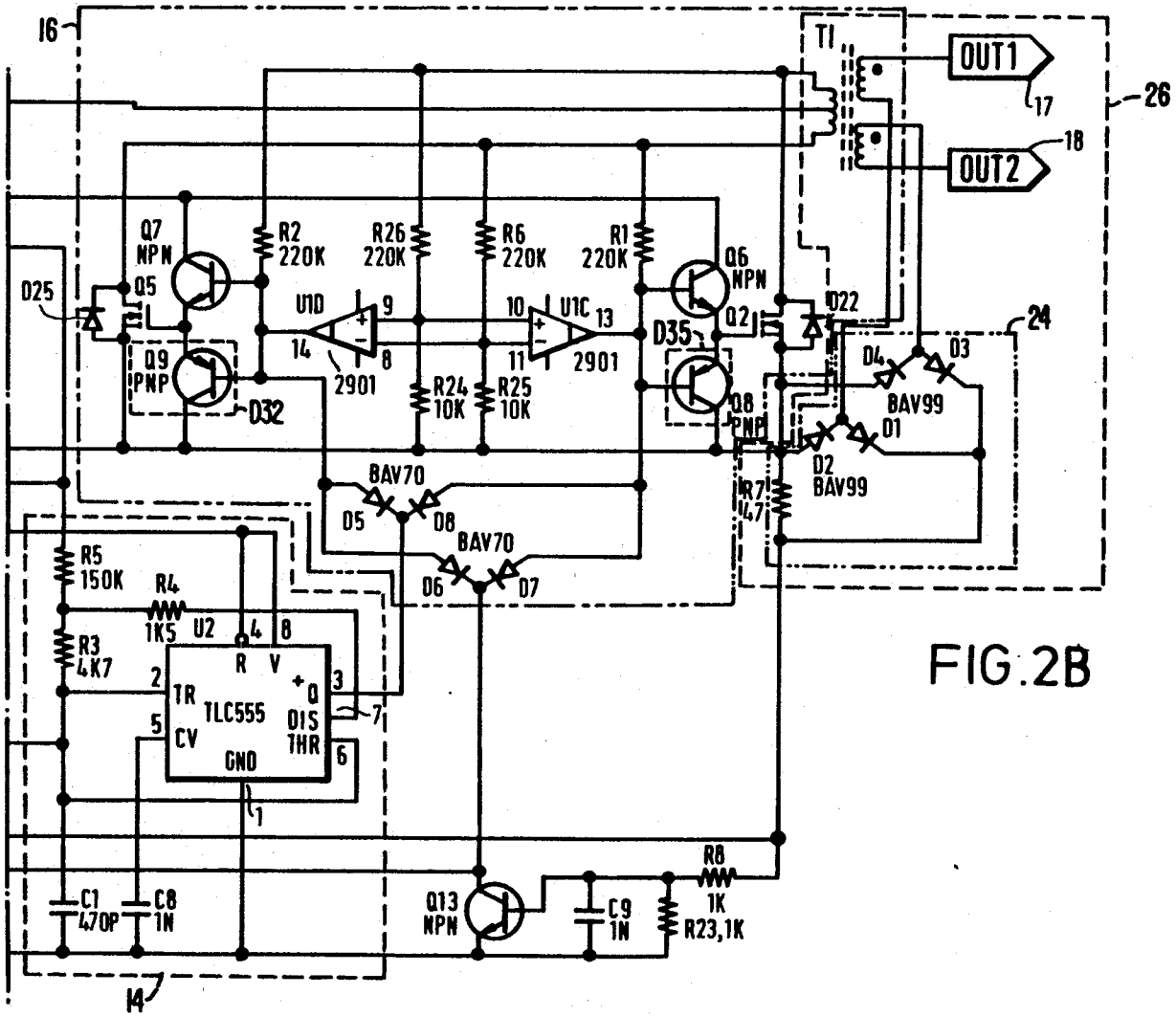

Referring to the more detailed circuit shown in FIGS. 2A and 2B where the same reference numerals correspond to equivalent components to those in FIG. 1, electronic switch Q1 is the main switch for the boost converter 12. Diode D9 is the output rectifier for the boost converter and capacitor C10 is the output capacitor. Under normal operation, the voltage across the capacitor C10 stays at around 20 to 25 V, depending on the current through the discharge lamp.

When striking, the voltage across C10 can go up to over 90 V, depending on the temperature of the lamp and the degree of light to which it is exposed. Thus it is well known that a warm tube requires less voltage to strike than a cold lamp and that a lamp in the dark requires a higher voltage than a lamp exposed to the light.

An external potentiometer RV connected to the DIM pin 30 controls the reference voltage at pin 7 of IC U1B. This voltage is used for regulating the lamp current.

The current flowing through the lamp, which equals the current flowing in the secondary of the output transformer T1, is rectified by a diode bridge consisting of diodes D1, D2, D3 and D4 and establishes a voltage across a resistor R7 that is proportional to the magnitude of the current. This voltage is fed back to pin 6 of U1B which acts as an error amplifier. The output of the error amplifier is used to control a pulse width modulation comparator U1A, which controls the switching of switch Q1 via driver transistors Q10 and Q11.

If the output current is lower than the preset current level, the boost converter will try to increase its output voltage to force a higher current into the lamp. By contrast, if the output current is higher than the preset current level, the boost converter will try to reduce its output voltage to reduce the current level.

The operating frequency of the boost converter is controlled by the voltage controlled oscillator IC U2 used in the output invertor. Integrated circuit U2 generates a sawtooth waveform across timing capacitor C1.

IC U2 is a common timer IC which runs at a frequency dependent on the output voltage of the boost converter. When the boost converter output voltage is higher, the charging current of timing capacitor C1, derived mainly from the boost converter output via resistor R5, increases. This reduces the ON (output pin 3 high) time for the timer IC. When the ON time reduces, the OFF (output pin 3 low) time increases due to the reduced discharge current of timer capacitor C1. However, the reduction in ON time is a lot more than the increase in OFF time. As a result, the timer IC U2 runs at a higher frequency when the boost converter output voltage rises.

Figure 3A:
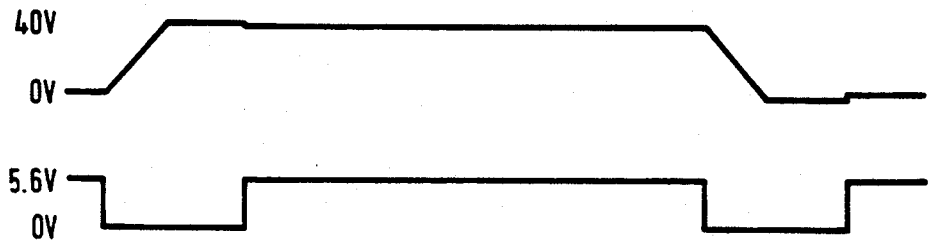
FIGS. 3A and 3B are waveform diagrams showing conditions at particular points in the circuit.
Figure 3B:
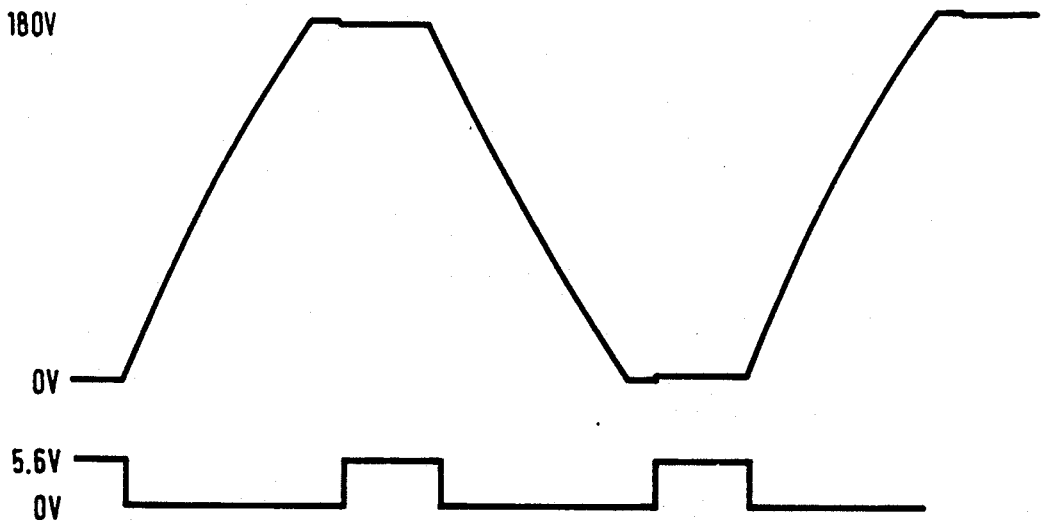

This is shown in particular by FIGS. 3A and 3B. Thus, the ON time of the timer IC will be almost inversely proportional to the boost converter output voltage, a smaller voltage transition requiring less time to resonate from zero voltage to the peak as shown in FIG. 3A than a larger voltage transition as shown in FIG. 3B. Typically at room temperature, with the lamp running, the ON time could be around 8.3 microseconds, and the OFF time about 2.5 microseconds so that the frequency would be 46 KHz (see FIG. 3A). To strike a lamp at room temperature, the ON time could be about 5.6 microseconds, the OFF time about 2.7 microseconds, and the frequency about 60 KHz. To strike a lamp at 0° C., the ON time would then be about 1.75 microseconds, the OFF time about 3.85 microseconds and so the frequency around 89 KHz (See FIG. 3B).

IC U2 runs at a frequency which is twice the operating frequency of the output power invertor. When output pin 3 of U2 is LOW at the end of each half cycle, it turns off the output transistors Q2 and Q5 via diodes D5, D8 and transistors Q8 and Q9. If transistor Q5 was on during one half cycle and was just turned off by IC U2, the magnetizing current built up in the output transformer winding would continue to flow, charging up the parasitic capacitance at the drain of transistor Q5 and discharging the parasitic capacitance at the drain of transistor Q2. As a result, the drain voltage of transistor Q5 rises to twice the boost converter output voltage and the drain voltage of transistor Q2 decreases to ground level until it is clamped by the body diode D22 of transistor Q2. The length of the OFF time for IC U2 is designed so that the above switching process is completed before IC U2 releases the gates of the switches, e.g. Q2 and Q5, allowing one of them to be turned on again, so that the switches Q2 and Q5 switch with zero voltage drop across them.

U1C and U1D detect the drain voltages of the output switches Q2 and Q5, allowing the switch with a lower drain voltage to turn on. Only one switch is thus allowed to turn on when U2 pin 3 output goes high and releases its disabling effect on the switches.

The transition period required for switching is longer when the boost converter output is high and the voltage controlled oscillator is running at a high frequency. Hence the timing is designed in such a way that, while the ON time of U2 decreases with higher boost converter output voltage, the OFF time (the time required for the magnetizing current in the output transformer to charge up/down parasitic capacitances) increases to allow for the higher voltage excursion.

NPN Transistor Q13 is used to limit the peak current flowing through the lamp immediately after it is struck and the boost converter output voltage across capacitor C10 is still at a high level. Thus because the voltage across capacitor C10 is still relatively high, a high voltage and hence a high current could force its way through the lamp. This current spike could be many times higher than the nominal operating current for the lamp and so adversely affect its life. Resistor R7 senses the current flowing through the lamp. If the current is too high, the voltage drop across resistor R7 can turn on transistor Q13 which:

a. switches off the boost converter temporarily by pulling pin 1 of U1B low via diode D12, and b. Pulls the gate voltages of switches Q5 and Q2 low, but not necessarily all the way to ground, via D6 and Q9, and D7 and Q8, respectively. Switch Q5 or Q2, depending which transistor is turned on, is thus forced to go into "linear" operation mode, i.e. not turned on fully. When switch Q5 or Q2 is partially turned on, there is a large voltage drop across their drain and source. The primary winding of transformer T1 now sees only part of the full boost converter output voltage. This scheme reduces the peak voltage across the lamp, and hence the peak current flowing through it once it starts to conduct. Most of the energy stored in boost converter output capacitor is therefore dissipated in the two FET switches Q2 and Q5 instead of in the lamp and FETs are inherently capable of handling such power transients without degradation. Transistor Q13 also provides output short circuit protection for the power invertor.

Transistors Q3 and Q4 allow the power invertor to be turned off by the REMOTE pin 32. Thus, when a signal is applied to pin 32 this turns off transistor Q4 which in turn turns off transistor Q3. When this occurs, the power supply to intermediate rail 23, powering IC U2, ceases and so that the boost converter, oscillator and power invertor are no longer driven. This is a feature required to conserve battery power in a laptop computer/portable word processor when the backlight is not required either by choice or a preset time after the last key stroke.

A latitude of modification, change and substitution is intended in the foregoing disclosure and in some instances some features of the invention will be employed without a corresponding use of other features. Accordingly it is appropriate that the appended claims be construed broadly and in a manner consistent with the spirit and scope of the invention herein.

I claim:

1. A power circuit for a fluorescent discharge lamp comprising:

converter means for producing a DC output voltage;

voltage controlled oscillator means driven by said DC output voltage from said converter means, said oscillator means providing an output, the frequency of said output increasing and decreasing with increases and decreases in the powering voltage of said DC output voltage from said converter means;

a power invertor receiving said output from said oscillator means and providing a high frequency output voltage driving said lamp directly without the need for a ballasting reactance, said high frequency output voltage being directly proportional to said DC output voltage; and current detection means for determining the current passing through said lamp and controlling said DC output voltage of said converter means according to that current to increase the voltage to strike the lamp and then control said voltage to give the required running current.

2. A power circuit according to claim 1 in which said running current flowing through said lamp is user adjustable to vary the brightness of said lamp.

3. A power circuit according to claim 1 in which said converter means comprises an inductor, an electronic switch controlling the switching of current through said inductor, a capacitor, and means for rectifying said output from said inductor and storing said rectified output in said capacitor, the potential across said capacitor providing said DC output voltage to supply said voltage controlled oscillator.

4. A power circuit according to claim 3 in which in order to vary the potential of the DC output voltage, the duty cycle of the switching of said electronic switch is varied.

5. A power circuit according to claim 2 in which the brightness of said lamp is controlled by controlling said converter to vary said DC output voltage to said voltage controlled oscillator.

6. A power circuit according to claim 1 in which said power invertor includes a transformer having a primary driven by said oscillator means and a secondary connected directly to said lamp.

7. A power circuit according to claim 6 in which the output from said oscillator is of a square shape or a trapezoidal shape.

8. A power circuit according to claim 7 in which the magnetic energy in said transformer charges the parasitic capacitances in electronic switches controlling said oscillator and the switching of the electronic switches only occurs when there is zero voltage drop across them.

9. A method of operating a fluorescent discharge lamp in which said lamp is driven by means of a high frequency high voltage power source, an output voltage of which drives the primary of a transformer with the secondary directly connected to said lamp, said power source including a voltage controlled oscillator driven by an input DC supply voltage, the frequency of oscillation of the voltage controlled oscillator increasing and decreasing with increases and decreases in said input DC supply voltage, and the output voltage from said power source being directly proportional to said input DC supply voltage, and current detection means being provided for detecting the current through said lamp and for increasing the input DC supply voltage and accordingly the frequency of oscillation and output voltage when zero or low current is detected so as to ensure initial striking of said lamp, in which during striking of said lamp the frequency of oscillation is in the range of from 40 to 400 KHz whilst during operation of the lamp the frequency of oscillation is in the range of from 20 to 70 KHz.

10. A method according to claim 9 in which the oscillation frequency during operation of said lamp is about 55 KHz, and the oscillation frequency during striking of said lamp is about 150 KHz.

11. A method according to claim 9 in which the output from said oscillator is of a square shape or trapezoidal shape.

12. A method according to claim 9 in which the magnetic energy in said transformer charges the parasitic capacitances in electronic switches controlling the oscillator and the switching of the electronic switches only occurs when there is zero voltage drop across them.

13. A method of operating a fluorescent discharge lamp in which said lamp is driven by means of a high frequency high voltage power source, an output voltage of which drives the primary of a transformer with the secondary directly connected to said lamp, said power source including a voltage controlled oscillator driven by an input DC supply voltage, the frequency of oscillation of the voltage controller oscillator increasing and decreasing with increases and decreases in said input DC supply voltage, and the output voltage from said power source being directly proportional to said input DC supply voltage, and current detection means being provided for monitoring the current through said lamp and for increasing the input DC supply voltage and accordingly the frequency of oscillation and output voltage when zero or low current is detected so as to ensure initial striking of said lamp, in which the driving signal applied to the lamp is a signal of a square shape or trapezoidal shape.

* * * * *